US007367266B2

(12) United States Patent
Takeda et al.

(10) Patent No.: US 7,367,266 B2
(45) Date of Patent: May 6, 2008

(54) PLATE FEEDING APPARATUS

(75) Inventors: Morihiro Takeda, Kyoto (JP); Hiroshi Miyoshi, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 11/727,681

(22) Filed: Mar. 28, 2007

(65) Prior Publication Data

US 2007/0227387 A1 Oct. 4, 2007

(30) Foreign Application Priority Data

Mar. 31, 2006 (JP) ..... 2006-097315

(51) Int. Cl.
*B41L 47/14* (2006.01)

(52) U.S. Cl. ..... 101/477; 271/9.08; 414/797

(58) Field of Classification Search ..... 101/477, 101/479, 480; 414/797, 416.03; 271/9.08, 271/105

See application file for complete search history.

(56) References Cited

U.S. PATENT DOCUMENTS 6,341,932 B1 1/2002 Otsuji
2005/0241517 A1* 11/2005 Trilk et al. ..... 101/477

FOREIGN PATENT DOCUMENTS

JP 2000-351460 12/2000
JP 2003-287899 10/2003

* cited by examiner

*Primary Examiner*—Leslie J. Evanisko
(74) *Attorney, Agent, or Firm*—McDermott Will & Emery LLP

(57) ABSTRACT

A plate feeding apparatus includes a multi-cassette unit for storing, in a stacked state, a plurality of cassettes storing plates, a loader unit for fetching from each cassette plates to be fed to an image recorder, and a plate feed unit disposed above the multi-cassette unit to be tiltable about a horizontal axis in a state of having a portion thereof vertically overlapping the multi-cassette unit.

5 Claims, 7 Drawing Sheets

PLATE FEEDING APPARATUS

BACKGROUND OF THE INVENTION

1. Field of the Invention

This invention relates to a plate feeding apparatus for feeding plates stored in cassettes to an image recorder for recording an image on the plates.

2. Description of the Related Art

To make color prints, for example, printing plates for four colors of Y (yellow), M (magenta), C (cyan) and K (black) are used. Such printing plates are prepared using an image recorder called a CTP (Computer To Plate) machine that records an image directly on plates such as PS plates (Pre-Sensitized Plates). This image recorder has a construction for recording a desired image on plates by irradiating the plates with light beams modulated according to image signals of Y (yellow), M (magenta), C (cyan) and K (black).

On the other hand, a plate feeding apparatus for automatically feeding the plates to such an image recorder includes cassettes storing the plates, and a transport mechanism for transporting the plates from inside the cassettes to the image recorder.

Where large plates are used to print a large image, the transport mechanism also has an increased size in order to transport the large plates. Consequently, the apparatus requires a large area for installation and an increased height for feeding the plates, giving rise to problems of accommodation space and maintainability of the apparatus.

To cope with such a situation, a plate feeding apparatus proposed in Japanese Unexamined Patent Publication No. 2003-287899 includes a multi-cassette unit for receiving, as stacked one over the other, a plurality of cassettes storing plates, a feed tray unit having a tilted plate feeding tray for guiding the plates placed thereon to an image recorder, an auto loader unit for transporting the plates from inside the cassettes to a lower end of the plate feeding tray, and a plate feed unit for feeding the plates into the cassettes.

In order to feed the plates to the image recorder, the plate feeding apparatus described in the above publication requires the multi-cassette unit and plate feed unit separately from the auto loader unit. This poses a problem that the entire plate feeding apparatus requires a large area for installation. Such a problem becomes serious especially when large-size plates are to be fed to the image recorder.

SUMMARY OF THE INVENTION

The object of this invention, therefore, is to provide a plate feeding apparatus requiring a minimal area for installation.

The above object is fulfilled, according to this invention, by a plate feeding apparatus for feeding plates to an image recorder, comprising a multi-cassette unit for storing, in a stacked state, a plurality of cassettes storing the plates; a loader unit for fetching from each of the cassettes the plates to be fed to the image recorder; a first horizontal moving mechanism for horizontally moving the cassettes stored in the multi-cassette unit between the multi-cassette unit and the loader unit; a lift mechanism for vertically moving the cassettes horizontally moved by the first horizontal moving mechanism to a plate feed position for feeding the plates to the image recorder; a plate feed unit disposed above the multi-cassette unit to be tiltable about a horizontal axis in a state of having a portion thereof vertically overlapping the multi-cassette unit; and a second horizontal moving mechanism for horizontally moving the cassettes between the loader unit and the plate feed unit.

This plate feeding apparatus realizes a reduced area for installation.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
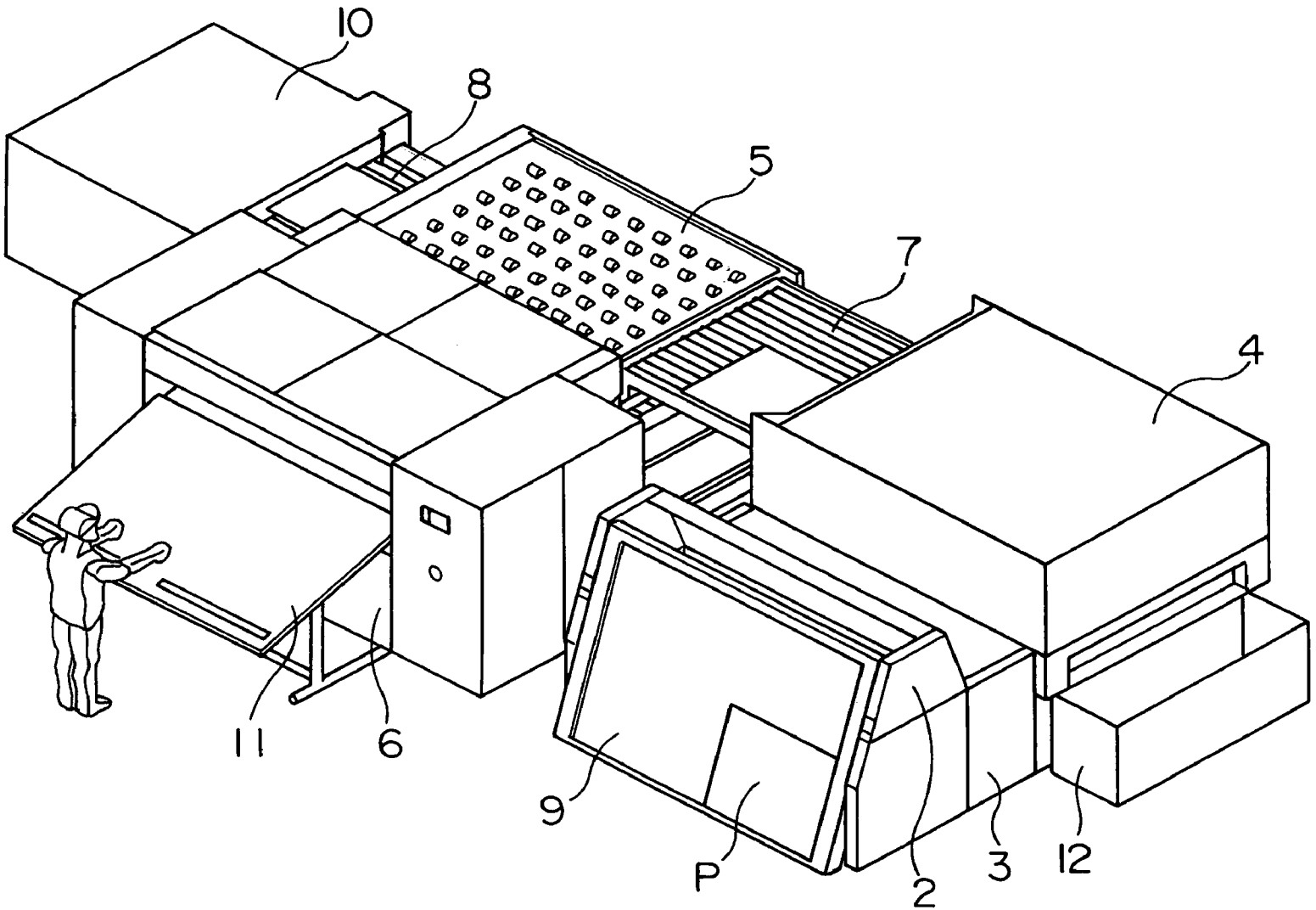
FIG. 1 is a perspective view of an image recording system having a plate feeding apparatus according to this invention.

An embodiment of this invention will be described hereinafter with reference to the drawings. FIG. 1 is a perspective view of an image recording system having a plate feeding apparatus according to this invention.

This image recording system includes a plate feed unit 2 for use in depositing plates P in each cassette 9, a multi-cassette unit 3 having a plurality of cassettes 9 stacked one over the other, a loader unit 4 for fetching and transporting plates P from a cassette 9 moved to a plate feed position, a plate transport device 5 for loading and unloading plates P into/from an image recorder 6, a conveyor 7 for transporting plates P from the loader unit 4 to the plate transport device 5, a plate developing device 10, and a conveyor 8 for transporting plates P from the plate transport device 5 to the developing device 10.

The image recorder 6 has a feed table 11 attached thereto for receiving plates P fed manually. The loader unit 4 has a guard paper exhausting section 12 for collecting guard paper inserted between the plates P.

In this image recording system, the multi-cassette unit 3 accommodates a plurality of cassettes 9 stacked one over the other. When transporting plates P in a cassette 9 to the image recorder 6, the required cassette 9 is moved to the loader unit 4. When storing new plates in a cassette 9, the cassette 9 is moved to the plate feed unit 2. The image recorder 6 records an image on the plates P loaded therein from the loader unit 4 through the conveyor 7 and plate transport device 5. The plates P with the image recorded thereon are transported to the developing device 10 through the plate transport device 5 and conveyor 8 to undergo a developing process.

Figure 2:
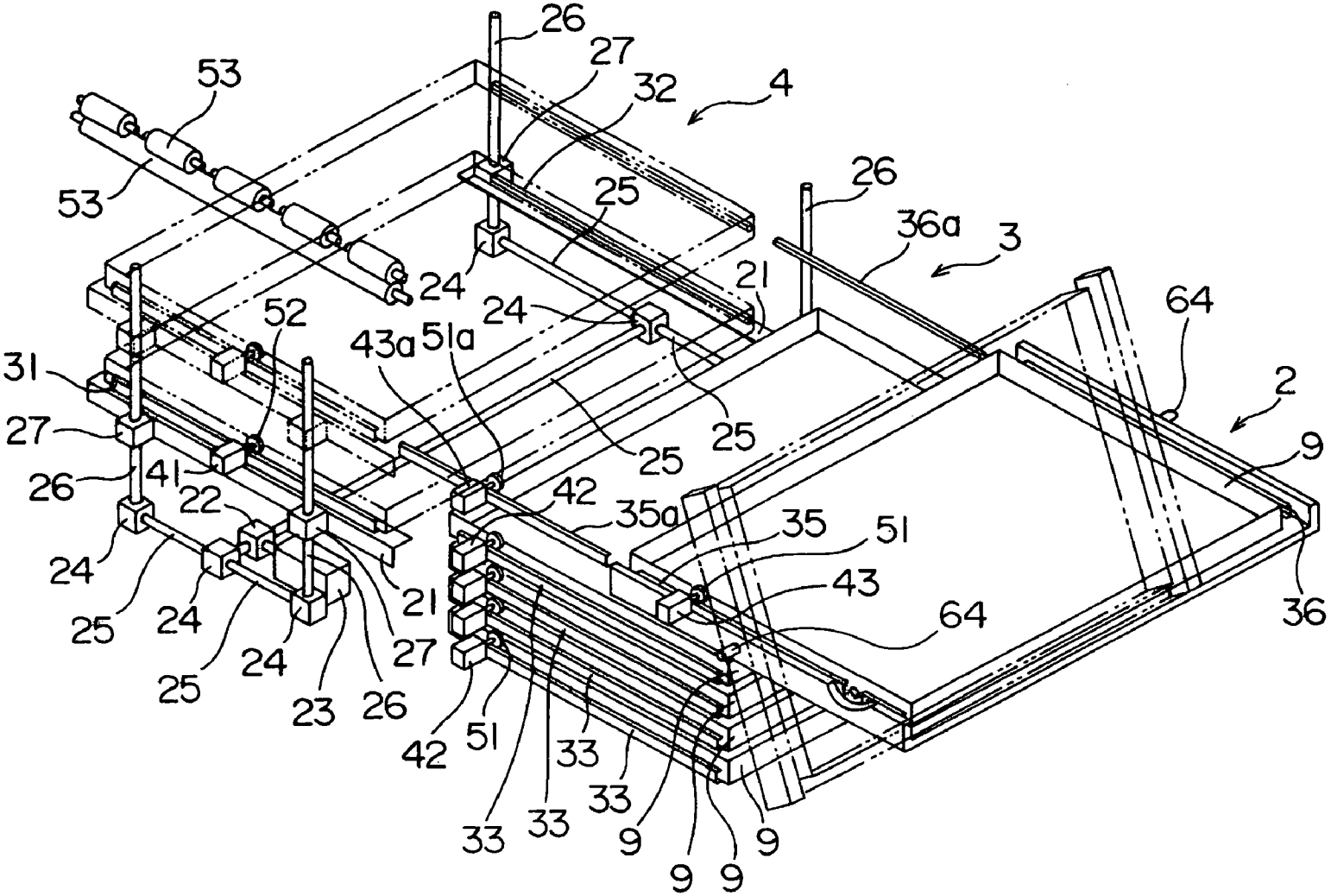
FIG. 2 is a perspective view showing a plate feed unit, a multi-cassette unit and a loader unit.
Figure 3:
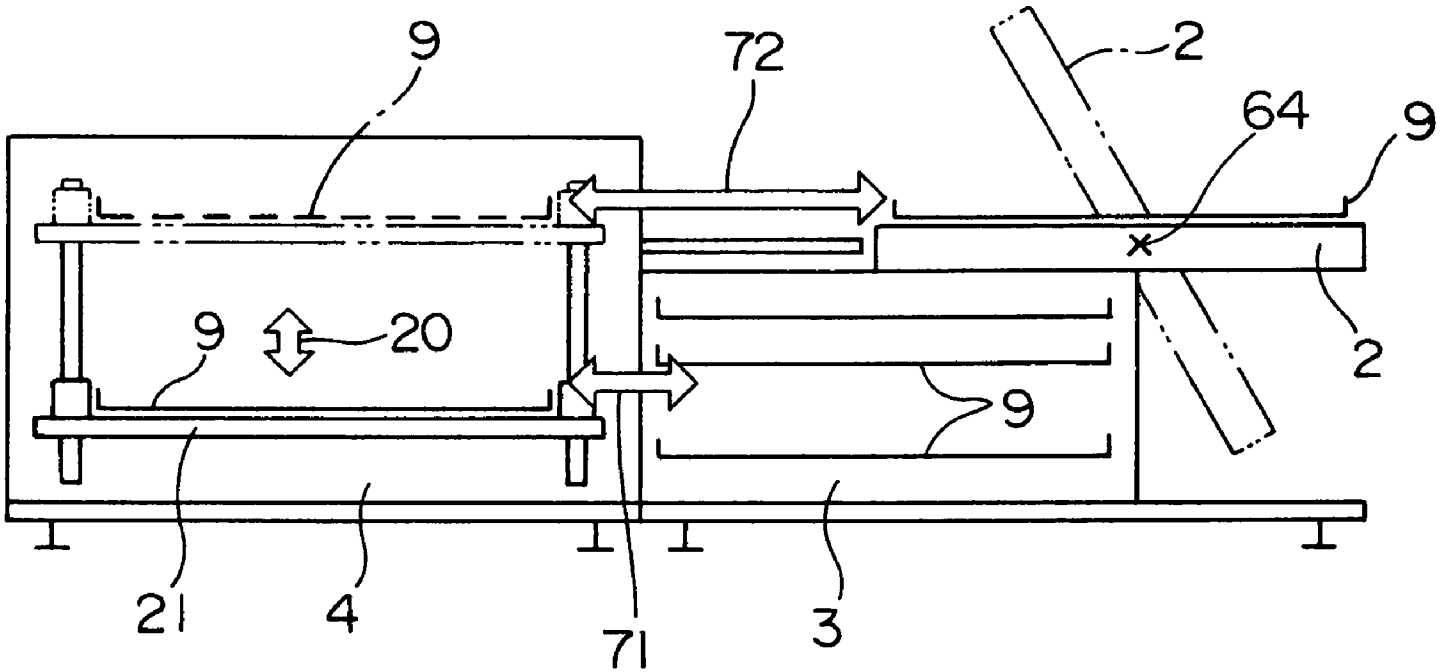
FIG. 3 is a side view showing the plate feed unit, multi-cassette unit and loader unit.
Figure 4:
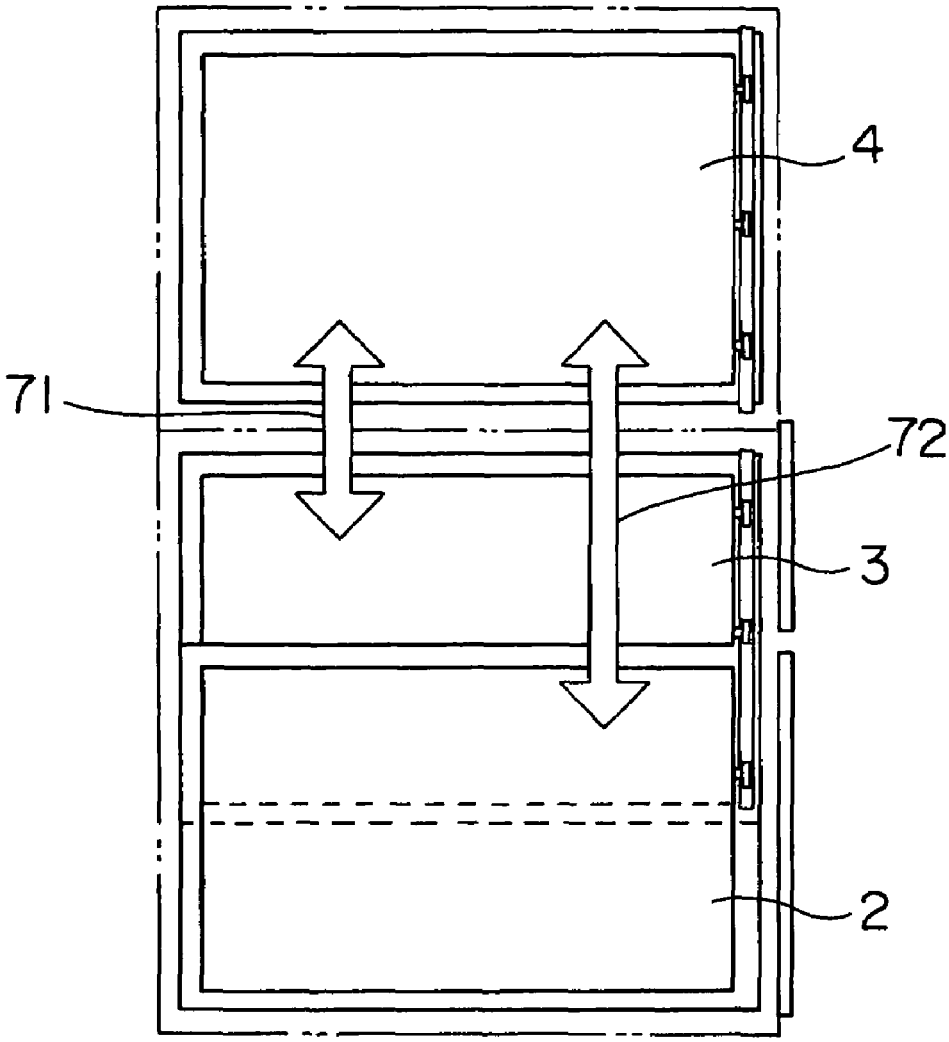
FIG. 4 is a plan view showing the plate feed unit, multi-cassette unit and loader unit.

Next, a first horizontal moving mechanism 71 for horizontally moving cassettes 9 between the multi-cassette unit 3 and loader unit 4, a lift mechanism 20 for vertically moving cassettes 9, and a second horizontal moving mechanism 72 for horizontally moving cassettes 9 between the loader unit 4 and plate feed unit 2, will be described. FIG. 2 is a perspective view showing the plate feed unit 2, multi-cassette unit 3 and loader unit 4. FIG. 3 is a side view and FIG. 4 is a plan view of these units.

As shown in FIGS. 2 and 3, the cassettes 9 are stacked in four stages in the multi-cassette unit 3. Each cassette 9 stores plates P as superposed with guard paper inserted in between.

The loader unit 4 has a pair of right and left lift members 21 arranged therein. The loader unit 4 has also a lift motor 23 disposed in a lower intermediate position thereof, with a miter gear 22 attached to a rotary shaft. The miter gear 22 is connected through a plurality of miter gears 24 and a plurality of shafts 25 to ball screws 26 meshed with threaded elements 27 attached to the lift members 21 noted above. Thus, the lift members 21 are vertically movable by the drive of lift motor 23.

A guide rail 31 and a motor 41 are provided for one of the right and left lift members 21, while a support rail 32 is provided for the other lift member 21. These guide rail 31, support rail 32 and motor 41 are vertically movable with the lift members 21.

The multi-cassette unit 3 has four guide rails 33, four motors 42, one guide rail 35*a* and one motor 43*a* arranged vertically on one side (first side) thereof, and four support rails 34 (not shown in FIG. 2) and one support rail 36*a* arranged vertically on the other side (second side). The four guide rails 33, four support rails 34 and four motors 42 are arranged in positions corresponding to the four cassettes 9.

The plate feed unit 2 has a guide rail 35 and a motor 43 arranged on a first side thereof, and a support rail 36 arranged on a second side. The guide rail 35*a* and support rail 36*a* arranged at the uppermost level of the multi-cassette unit 3 are set to a height for allowing the cassettes 9 to move horizontally to and from the plate feed unit 2 having pivoted to a horizontal position.

Figure 5A:
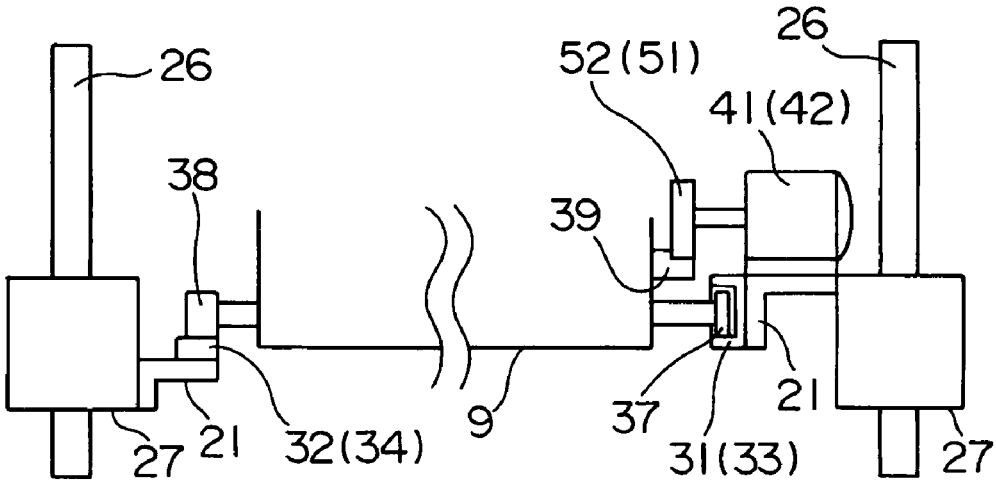
FIG. 5A is an enlarged view of principal parts showing a relationship between a cassette, guide rails and support rails.

FIG. 5A is an explanatory view of the first horizontal moving mechanism 71 for horizontally moving cassettes 9 between the loader unit 4 and multi-cassette unit 3. FIG. 5A is a side view of principal parts of the loader unit 4 and multi-cassette unit 3 seen from the loader unit 4.

When each cassette 9 is in the loader unit 4, as shown in FIG. 5A, a roller 37 disposed laterally outward of a first side of the cassette 9 engages the guide rail 31 provided for the lift member 21 of the loader unit 4. A roller 38 disposed laterally outward of a second side of each cassette 9 engages the support rail 32 provided for the lift member 21 in the loader unit 4. A rack 39 disposed laterally outward of the first side of each cassette 9 is meshed with a pinion 52 rotatable by the motor 41 fixed to the lift member 21.

Before the cassette 9 is moved between the loader unit 4 and multi-cassette unit 3 by the first horizontal moving mechanism 71, the lift mechanism 20 positions each of the guide rail 31 and support rail 32 of the loader unit 4 at a height opposed to one of the four guide rails 33 or one of the support rails 34 in the multi-cassette unit 3.

Thus, when the motor 41 is operated to rotate the pinion 52, the rack 39 is driven sideways, thereby moving the entire cassette 9 rightward in FIG. 3 (i.e. in a direction normal to the plane of FIG. 5A). As a result, the cassette 9 moves horizontally from the loader unit 4 toward the multi-cassette unit 3. At this time, the rack 39 is meshed with the pinion 52 initially, and subsequently with the pinion 51 rotated by the motor 42, whereby the cassette 9 continuously receives a horizontal driving force. Finally, the cassette 9 stops in a state of being supported by the guide rail 33 and support rail 34 in the multi-cassette unit 3.

Figure 5B:
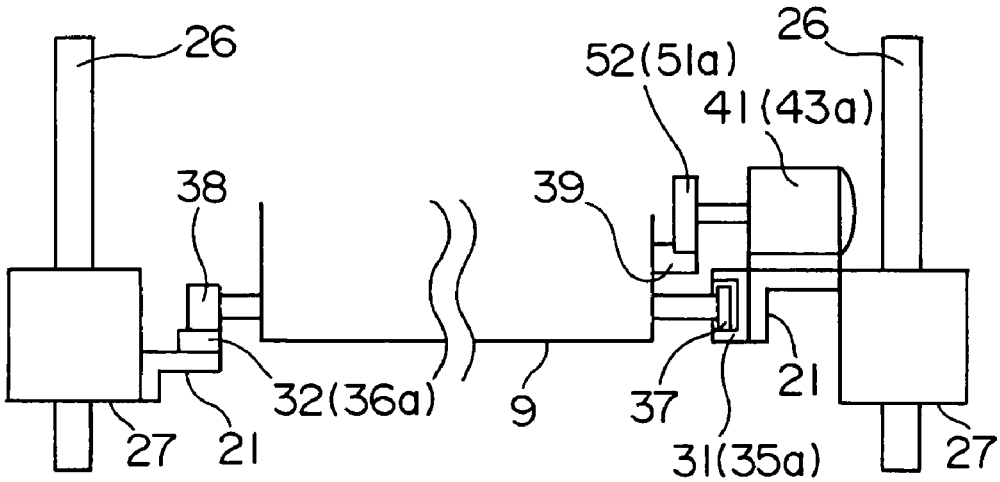
FIG. 5B is an enlarged view of the principal parts showing the relationship between a cassette, guide rails and support rails.

FIG. 5B is an explanatory view of part of the second horizontal moving mechanism 72 for horizontally moving cassettes 9 between the loader unit 4 and plate feed unit 2. FIG. 5B is a side view of principal parts of the loader unit 4 and multi-cassette unit 3 seen from the loader unit 4.

When each cassette 9 is in the loader unit 4, as shown in FIG. 5B, the roller 37 disposed laterally outward of the first side of the cassette 9 engages the guide rail 31 provided for the lift member 21 in the loader unit 4. The roller 38 disposed laterally outward of the second side of each cassette 9 engages the support rail 32 provided for the lift member 21 in the loader unit 4. The rack 39 disposed laterally outward of the first side of each cassette 9 is meshed with the pinion 52 rotatable by the drive of motor 41 fixed to the lift member 21.

Before the cassette 9 is moved between the loader unit 4 and multi-cassette unit 3 by the second horizontal moving mechanism 72, the lift mechanism 20 positions the guide rail 31 and support rail 32 of the loader unit 4 at a height opposed to the uppermost guide rail 35*a* and support rail 36*a* of the multi-cassette unit 3.

Thus, when the motor 41 is operated to rotate the pinion 52, the rack 39 is driven sideways, thereby moving the entire cassette 9 rightward in FIG. 3 (i.e. in a direction normal to the plane of FIG. 5B). As a result, the cassette 9 moves horizontally from the loader unit 4 toward the multi-cassette unit 3. At this time, the rack 39 is meshed with the pinion 52 initially, and subsequently with a pinion 51*a* rotated by the motor 43*a*, whereby the cassette 9 continuously receives a horizontal driving force. Consequently, the cassette 9 moves to a position supportable by the uppermost guide rail 35*a* and support rail 36*a* of the multi-cassette unit 3.

Figure 5C:
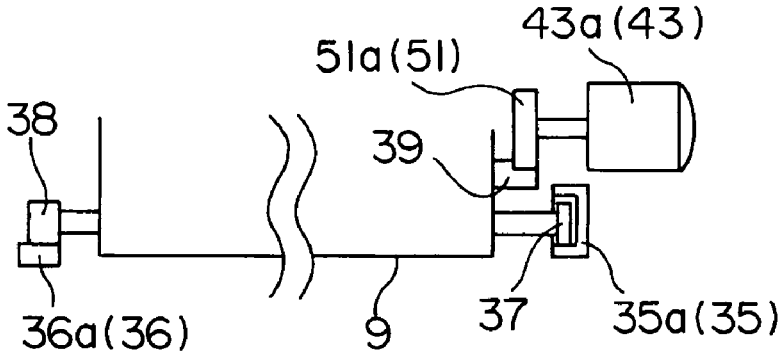
FIG. 5C is an enlarged view of the principal parts showing the relationship between a cassette, guide rails and support rails.

FIG. 5C is an explanatory view of part of the second horizontal moving mechanism 72 for horizontally moving cassettes 9 between the loader unit 4 and plate feed unit 2. FIG. 5C is a side view of principal parts of the multi-cassette unit 3 and plate feed unit 2 seen from the multi-cassette unit 3.

Before each cassette 9 is moved between the multi-cassette unit 3 and plate feed unit 2 by the second horizontal moving mechanism 72, a pivoting mechanism to be described hereinafter positions the guide rail 35 and support rail 36 of the plate feed unit 2 at a height opposed to the uppermost guide rail 35*a* and support rail 36*a* of the multi-cassette unit 3.

Thus, when the motor 43*a* is operated to rotate the pinion 51*a*, the rack 39 is driven sideways, thereby moving the entire cassette 9 rightward in FIG. 3 (i.e. in a direction normal to the plane of FIG. 5C). As a result, the cassette 9 moves horizontally from the multi-cassette unit 3 toward the plate feed unit 2. At this time, the rack 39 is meshed with the pinion 51*a* initially, and subsequently with the pinion 51 rotated by the motor 43, whereby the cassette 9 continuously receives a horizontal driving force. Consequently, the cassette 9 moves from the position supported by the uppermost guide rail 35*a* and support rail 36*a* of the multi-cassette unit 3 to a position supported by the guide rail 35 and support rail 36 of the plate feed unit 2 in the horizontal position.

In order to realize the continuous horizontal movement of each cassette 9 between the loader unit 4 and multi-cassette units 3 and between loader unit 4, multi-cassette unit 3 and the plate feed unit 2 as described above, the rack 39 has a horizontal length set larger than any one of a horizontal distance between the pinion 52 rotatable by the motor 41 and the pinion 51 rotatable by the motor 42, a horizontal distance between the pinion 52 rotatable by the motor 41 and the pinion 51*a* rotatable by the motor 43*a*, and a horizontal distance between the pinion 51*a* rotatable by the motor 43*a* and the pinion 51 rotatable by the motor 43.

Figure 6:
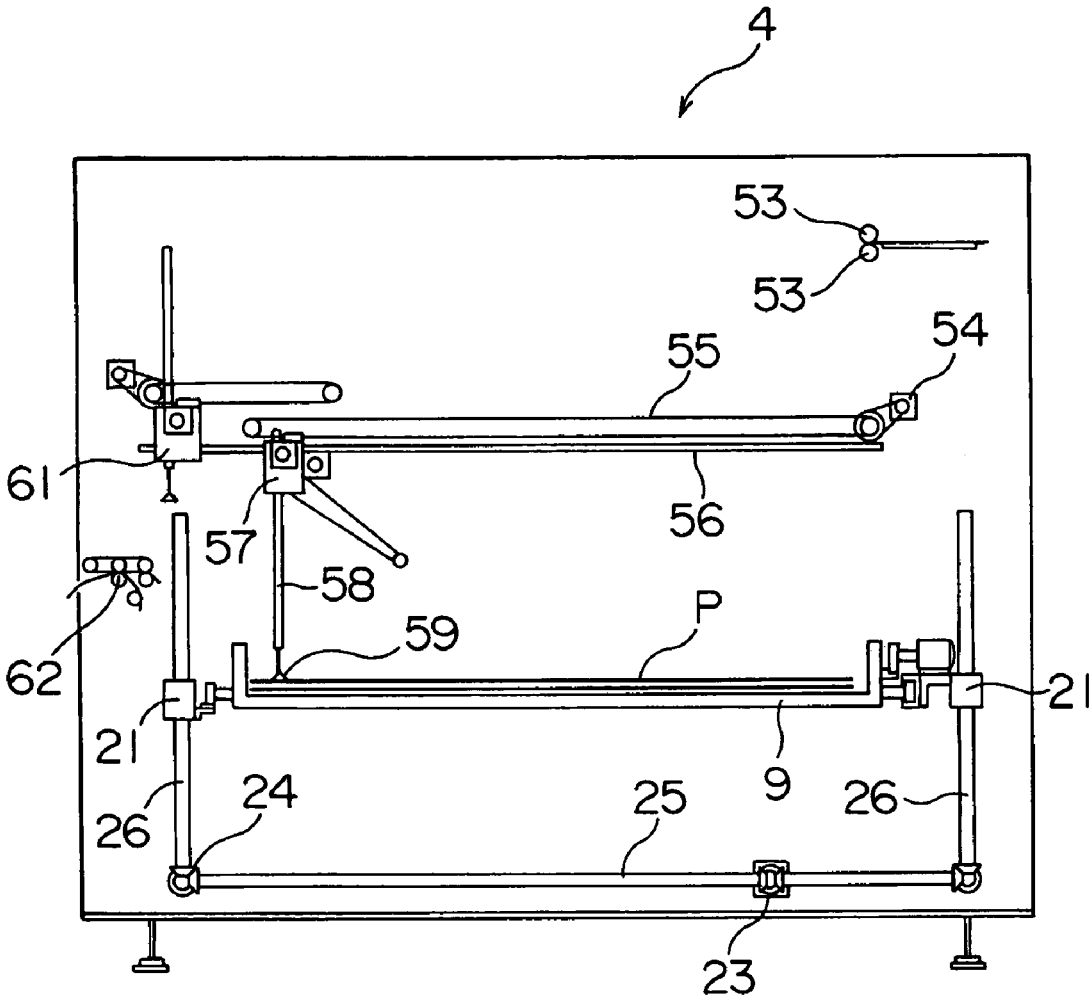
FIG. 6 is a schematic view showing the construction of the loader unit.

The construction of the loader unit 4 will be described next. FIG. 6 is a schematic view showing the construction of the loader unit 4.

The loader unit 4 serves to transport plates P from a cassette 9 having moved to the plate feed position shown in FIG. 6 toward a discharge roller pair 53 arranged at one end of the conveyor 7. The loader unit 4 includes a mobile member 57 driven by an endless synchronous belt 55 rotatable by a motor 54, to run along a guide rail 56. The mobile member 57 has a pinion (not shown) meshed with a rack (not shown) extending parallel to the guide rail 56, and an arm 58 fixed to the pinion. The arm 58 has a plurality of suction pads 59 attached to a distal end thereof for sucking and holding the plates P.

With the loader unit 4 having the above construction, when the mobile member 57 is driven by the motor 54 to move rightward from the position shown in FIG. 6, the arm 58 pivots about the axis of the pinion. As the mobile member 57 is moved rightward by the motor 54, with the suction pads 59 sucking and holding a forward end of a plate P, the plate P held by the suction pads 59 is first turned over to have the back surface facing up, and thereafter the forward end is pinched between the discharge roller pair 53 so that the plate P is transported toward the conveyor 7.

The loader unit 4 further includes a guard paper discharge mechanism 61 for discharging the guard paper inserted between the plates P stored in each cassette 9. The guard paper discharge mechanism 61 discharges the guard paper through discharge rollers 62 to the guard paper exhausting section 12 shown in FIG. 1.

Figure 7:
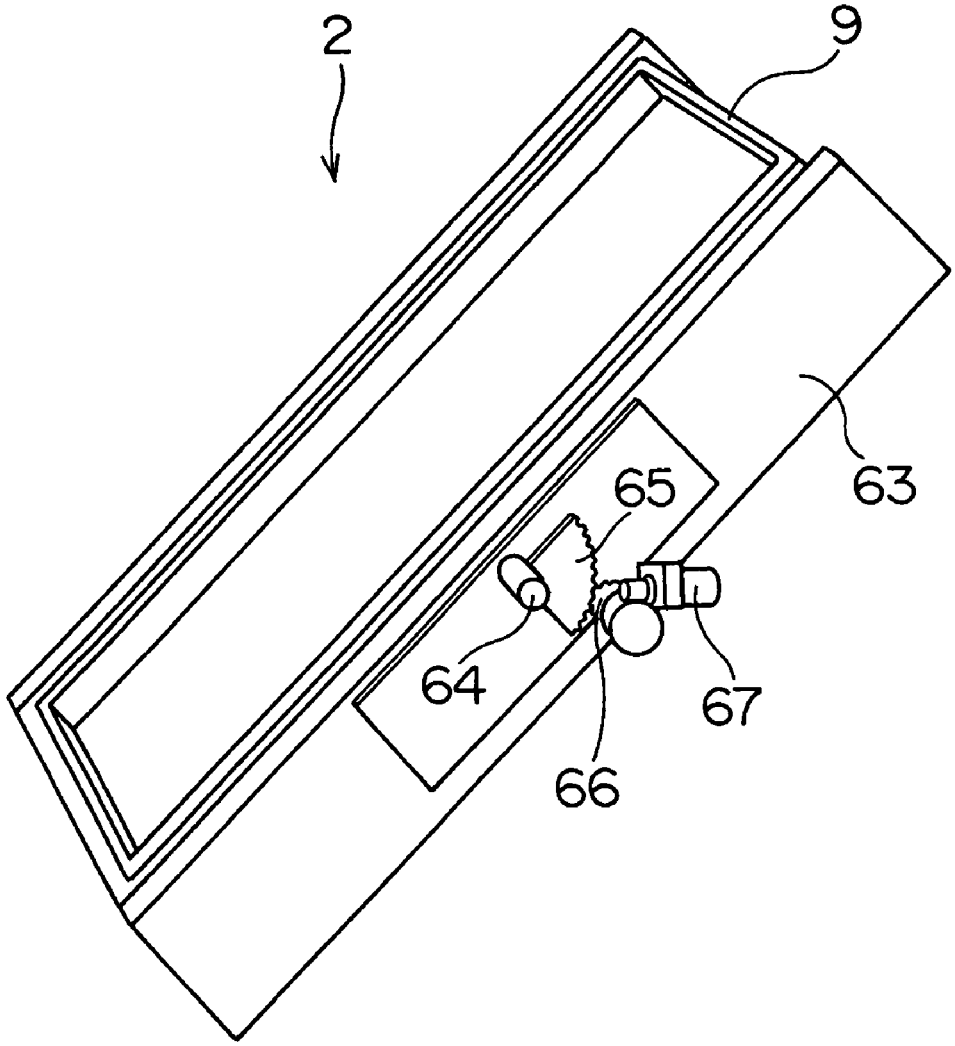
FIG. 7 is a perspective view showing a principal part of the plate feed unit.

The construction of the plate feed unit 2 will be described next. FIG. 7 is a perspective view showing a principal part of the plate feed unit 2.

The plate feed unit 2 includes a frame 63 for storing cassettes 9 inside. The frame 63 has the guide rail 35, motor 43 and support rail 36 arranged therein. The frame 63 is pivotable about a shaft 64 having a spur gear 65 formed peripherally of and coaxially with the shaft 64. On the other hand, a gear 66 is attached to a main apparatus body to be rotatable by a motor 67. Consequently, the frame 63 is constructed pivotable by the motor 67 between a horizontal position shown in solid lines in FIGS. 2 and 3 and a tilted position shown in phantom lines in FIGS. 2 and 3.

The above-noted shaft 64 is located above an end of the multi-cassette unit 3 remote from the loader unit 4. Thus, the frame 63 is pivotable about an axis adjacent this end of the multi-cassette unit 3. Consequently, when the frame 63 assumes the horizontal position and tilted position, approximately a half of the frame 63 lies over the multi-cassette unit 3.

In the image recording system having the above construction, when storing new plates P in a selected cassette 9 in the multi-cassette unit 3, the motor 67 shown in FIG. 7 is operated first to set the frame 63 of the plate feed unit 2 to the horizontal position. Further, the lift motor 23 shown in FIGS. 2 and 6 is operated to move the lift members 21 vertically to a height opposed to the cassette 9, which is to receive the plates P, in the multi-cassette unit 3.

Next, the motor 42 shown in FIG. 2 is operated to move the cassette 9 in the multi-cassette unit 3 toward the loader unit 4. Before the rack 39 attached to the cassette 9 disengages from the pinion 51 rotated by the motor 42, the rack 39 meshes with the pinion 52 rotated by the motor 41. Thus, after the rack 39 disengages from the pinion 51, this cassette 9 is stored in the loader unit 4 by the drive of motor 41. Next, the lift motor 23 raises the lift members 21 to the height opposed to the plate feed unit 2 in the horizontal position. Then, the motor 41 is operated to move the cassette 9 in the loader unit 4 toward the plate feed unit 2. Before the rack 39 attached to the cassette 9 disengages from the pinion 52 rotated by the motor 41, the rack 39 meshes with the pinion 51*a* rotated by the motor 43*a*. Thus, after the rack 39 disengages from the pinion 52, the cassette 9 is driven by the motor 43*a*. Similarly, before the rack 39 disengages from the pinion 51*a* rotated by the motor 43*a*, the rack 39 meshes with the pinion 51 rotated by the motor 43. Thus, after the rack 39 disengages from the pinion 51*a*, the cassette 9 is driven by the motor 43. By successively operating the plurality of motors 41, 43*a* and 43 as described above, this cassette 9 is stored in the plate feed unit 2.

Subsequently, the motor 67 shown in FIG. 7 is operated to set the frame 63 of the plate feed unit 2 to the tilted position. In this state, the operator deposits a plurality of plates P one over the other, with guard paper inserted in between, in the cassette 9 in the plate feed unit 2. Since the cassette 9 is tilted at this time, a plurality of plates P are deposited easily in the cassette 9 even if the plates P are large-sized.

After the plates P are stored, the motor 67 is operated to return the frame 63 of the plate feed unit 2 to the horizontal position. Then, the motor 43 and motor 43*a* are operated to move the cassette 9 from the plate feed unit 2 toward the loader unit 4, and the motor 41 is operated to store the cassette 9 in the loader unit 4. Then, the lift motor 23 is operated to lower the cassette 9 to the height at which the cassette 9 was fetched. Subsequently, the motor 41 is operated to move the cassette 9 in the loader unit 4 toward the multi-cassette unit 3, and the motor 42 is operated to store this cassette 9 in the multi-cassette unit 3.

When feeding plates P to the image recorder 6 from a cassette 9 stored in the multi-cassette unit 3, the lift motor 23 is operated to move the lift members 21 vertically to a height opposed to the cassette 9 from which the plates are to be fed. Next, the motor 42 is operated to move the cassette 9 in the multi-cassette unit 3 toward the loader unit 4, and the motor 41 is operated to store this cassette 9 in the loader unit 4. Then, the lift motor 23 is operated to move the lift members 21 vertically to the position for feeding the plates P shown in FIG. 6. Subsequently, by the action of the suction pads 59, the plates P in the cassette 9 are transported toward the discharge roller pair 53 arranged at the end of the conveyor 7.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2006-097315 filed in the Japanese Patent Office on Mar. 31, 2006, the entire disclosure of which is incorporated herein by reference.

What is claimed is:

1. A plate feeding apparatus for feeding plates to an image recorder, comprising:

a multi-cassette unit for storing, in a stacked state, a plurality of cassettes storing the plates;

a loader unit for fetching from each of said cassettes the plates to be fed to the image recorder;

a first horizontal moving mechanism for horizontally moving the cassettes stored in said multi-cassette unit between said multi-cassette unit and said loader unit;

a lift mechanism for vertically moving the cassettes horizontally moved by said first horizontal moving mechanism to a plate feed position for feeding the plates to said image recorder;

a plate feed unit disposed above said multi-cassette unit to be tiltable about a horizontal axis in a state of having a portion thereof vertically overlapping said multi-cassette unit; and a second horizontal moving mechanism for horizontally moving said cassettes between said loader unit and said plate feed unit.

2. A plate feeding apparatus as defined in claim 1, wherein each of said cassettes has a rack attached to a side thereof, said first horizontal moving mechanism including a first guide device for guiding said cassettes horizontally, and a first pinion rotatable by a motor as meshed with said rack.

3. A plate feeding apparatus as defined in claim 2, wherein said lift mechanism includes a second guide device for guiding said cassettes horizontally, and a second pinion rotatable by a second motor as meshed with said rack, said first guide device and said second guide device being aligned by operation of said lift mechanism itself when said cassettes are horizontally moved between said multi-cassette unit and said loader unit.

4. A plate feeding apparatus as defined in claim 3, wherein said second horizontal moving mechanism includes a third guide device for guiding said cassettes horizontally, and a third pinion rotatable by a third motor as meshed with said rack, said second guide device and said third guide device being aligned by operation of said lift mechanism when said cassettes are horizontally moved between said loader unit and said plate feed unit.

5. A plate feeding apparatus as defined in claim 1, wherein said plate feed unit is tiltable about an axis disposed above an end of said multi-cassette unit remote from said loader unit.

* * * * *